US005943018A

United States Patent [19]

Miller

[11] Patent Number: 5,943,018

[45] Date of Patent: Aug. 24, 1999

[54] PORTABLE GPS RECEIVER UNIT

[75] Inventor: Robertson C. Miller, Costa Mesa, Calif.

[73] Assignee: Toshiba America Information Systems, Inc., Irvine, Calif.

[21] Appl. No.: 08/109,046

[22] Filed: Aug. 19, 1993

[51] Int. Cl.[6] ..... H01Q 1/24

[52] U.S. Cl. ..... 343/702

[58] Field of Search ..... 343/702, 871, 343/877, 873; 455/269; H01Q 1/12, 1/24, 1/22

[56] References Cited

U.S. PATENT DOCUMENTS

| | | | |
|---|---|---|---|
| 2,486,536 | 11/1949 | Olson | 343/702 |
| 2,565,661 | 8/1951 | Lidz | 343/702 |
| 4,479,263 | 10/1984 | Rosenfeldt et al. | 455/602 |
| 5,020,926 | 6/1991 | Wilhelm | 400/54 |
| 5,043,736 | 8/1991 | Darnell et al. | 342/357 |
| 5,050,041 | 9/1991 | Shafi | 361/391 |
| 5,075,693 | 12/1991 | McMillan et al. | 342/457 |
| 5,089,816 | 2/1992 | Holmes, Jr. | 340/995 |
| 5,138,328 | 8/1992 | Zibrik et al. | 343/702 |
| 5,300,938 | 4/1994 | Maroun et al. | 343/702 |

OTHER PUBLICATIONS

GESSA GPSpac Adv., GPS World, Jan. 1992., p. 42.
GESSA GPSpac Adv., GPS World, Sep. 1992. p. 10.
Toshiba (Japan) Portable Navigation System specification sheet.
Rockwell Navcore V Adv. GPS World, p. 13, Feb. 1992.
Skytel Skystream Avd., Sky Magazine, Oct. 1992.

*Primary Examiner*—Don Wong
*Attorney, Agent, or Firm*—Banner & Witcoff, Ltd.

[57] ABSTRACT

A portable GPS receiver unit is attachable to the underside of a portable computer and has a GPS antenna mounted for sliding movement into and out of a receiver housing. During periods of non-use, the antenna can be stowed within the receiver housing to provide a highly compact and portable unit. For usage, the antenna can be protruded from the housing to obtain a clear view of the sky. The antenna is made easily removable from its movable support surface so as to enable the antenna to be remotely placed. This can be accomplished by a magnet attached to the antenna which is attracted to the support surface, and which can be used to secure the antenna to other surfaces having a clear view of the sky, such as an automobile roof.

18 Claims, 3 Drawing Sheets

PORTABLE GPS RECEIVER UNIT

BACKGROUND OF THE INVENTION

The present invention relates to global positioning system (GPS) receivers, particularly portable GPS receiver units usable in connection with portable general purpose computers.

In the early 1970's, the U.S. government began development of a new satellite navigation system which has come to be known as the Global Positioning System (GPS). Although GPS is still undergoing experimentation and testing, GPS has been in practical use by the U.S. military and other specialized organizations for about 5 years and is expected to be declared fully operational within the next year or two.

As its name implies, GPS is a system which allows the user to precisely determine his or her location anywhere on earth. GPS is based upon satellite ranging. To accomplish this, a special GPS receiver is used to receive signals transmitted by a group of the orbiting satellites and thereby measure the distance between the receiver and each of the satellites within the group. The satellites act as precise reference points. To determine the user's position (latitude, longitude and altitude) the GPS receiver measures the distance to four satellites.

Each GPS satellite transmits by radio waves three primary signals, two of which correspond respectively to the current time and the satellite's position. The satellites determine their own position and the current time from on-board celestial navigation equipment and atomic clocks accurate to one second in 300,000 years. The third signal is a very long bit stream known as a pseudo-random noise code (PRN). The noise code is used by the receiver to calculate the range and position of three or four satellites. Once this is done, the GPS receiver can compute its own location by triangulation.

GPS receivers receive the satellite signals via a GPS antenna which must have a clear view of the sky. GPS antennas come in a variety of configurations, but typically comprise a coiled wire built into a relatively flat, e.g. saucer shaped, housing. Typically, the antenna is remotely located from the receiver unit and is connected thereto by a cable.

GPS has a myriad of present and potential future applications. Present applications include vehicle (e.g. ship, airplane and land vehicle) navigation and tracking, and surveying. GPS is also presently being used to disseminate precise time, time interval and frequency information (from the atomic clocks on board the satellites) to control timing signals and oscillators, e.g., in the communications and electric power industries.

GPS is being integrated with electronic mapping and charting systems as one of the latest steps in the evolution of navigational tools. Portable GPS receivers are being used in conjunction with portable computers to create detailed electronic facsimiles of street maps, for example, by tracking and recording a vehicle's movements. Once created, GPS and a microprocessor are used to display a vehicle's position against the background of the electronic map or chart.

The Global Positioning System has spawned a new industry for the production, sale and use of GPS receivers. Most of the receivers that have been offered are built into special purpose devices for navigation, surveying or other applications. Recently, GPS receivers units usable in connection with general purpose portable computers have been offered. Rockwell International has advertised an IC board called NavCore V (see GPS World, February 1992, page 13) which is adaptable for insertion into an expansion slot of a personal computer. Similar GPS expansion cards have been developed and offered by the following companies: Navstar Electronics, Magnavox and Koden Electronics. The marriage of GPS and portable general purpose computers allows for a flexibility in the application of GPS unattainable with the special purpose devices.

General Engineering & Systems S.A. (GESSA) has advertised a product called GPSpac, which represents an integration of the HP 95LX palmtop PC from Hewlett Packard and Rockwell's NavCore V five channel GPS receiver. See GPS World, January 1992, page 42. In the advertisement, the unit appears to be mounted underneath a palmtop computer with an antenna mounted off to the side. A problem with the GPSpac receiver unit is that it is bulky and not easily portable, due largely to the provision of a non-retractable GPS antenna connected to the outside of the main GPS receiver housing.

SUMMARY OF THE INVENTION

In view of the foregoing, it is a primary object of the invention to provide a GPS receiver unit usable in connection with a portable computer, and which is highly compact and portable.

It is a further object of the invention to provide a fully self contained GPS receiver unit which is quickly and easily removably attachable to a portable computer.

It is yet another object of the invention to provide a GPS receiver having a convenient arrangement for storage of the GPS antenna when it is not in use, and allowing, for use, local or remote positioning of the GPS antenna.

These and other objects are achieved by the present invention which is embodied in a portable GPS receiver unit. The GPS receiver unit has a GPS receiver engine, a housing enclosing the receiver engine, and a GPS antenna electrically connectable to the receiver engine and mountable to the housing for movement between a retracted position within the housing and an extended position protruding from the housing.

In a preferred embodiment, the receiver unit has attachment means provided on an upper surface of the housing for mating with the bottom side of a portable computer, and the antenna is mountable on a support surface of a carriage which is movably attached to the housing. The antenna may be provided with a magnet which magnetically retains the antenna on the support surface until such time as it is necessary to place the antenna in a remote location to obtain a clear view of the sky.

These and other objects and features of the invention will be fully appreciated and understood from the following detailed description and the accompanying drawings.

DETAILED DESCRIPTION OF THE PREFERRED EMBODIMENTS

Figure 1:
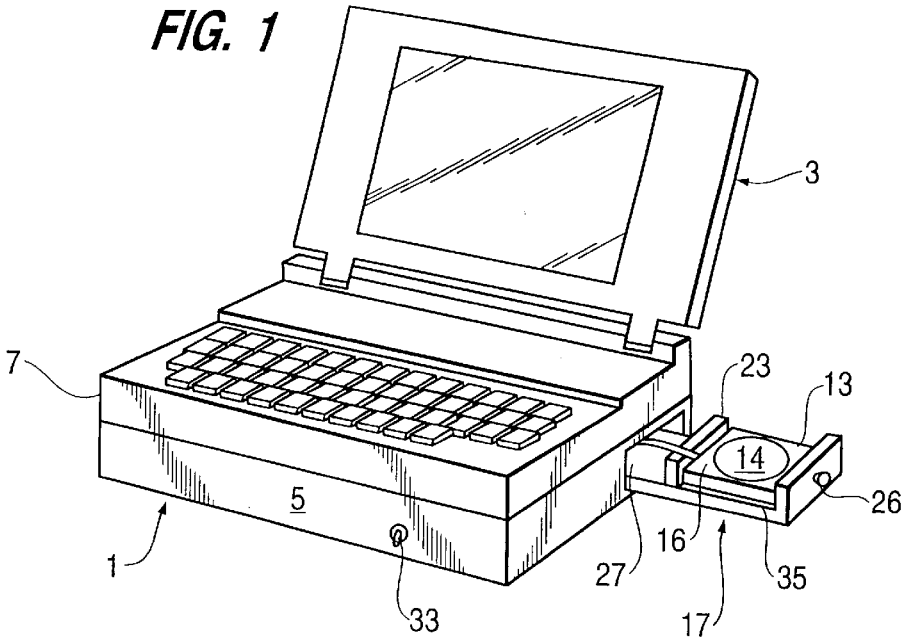
FIG. 1 is a pictorial view of a portable GPS receiver unit in accordance with the present invention, attached to the underside of a lap-top personal computer.

FIG. 1 illustrates a GPS receiver unit 1 in accordance with the present invention, attached to the underside of a lap-top personal computer 3. Receiver unit 1 comprises a housing 5 corresponding in length and width to a base 7 of computer 3. Housing 5 may be formed of metals and/or impact resistant molded plastics, applying principals generally known in the field of portable electronics chassis design. The housing height is minimized, e.g., to between ¾ and 1.25 inches, so that the combined computer and receiver unit is easily portable. Although housing 5 and computer base 7 are shown as separate components, it is contemplated that the receiver and computer components could be housed in a single common housing. In this case, the computer itself would be functional as a GPS receiver, without a separate attachment.

Figure 2:
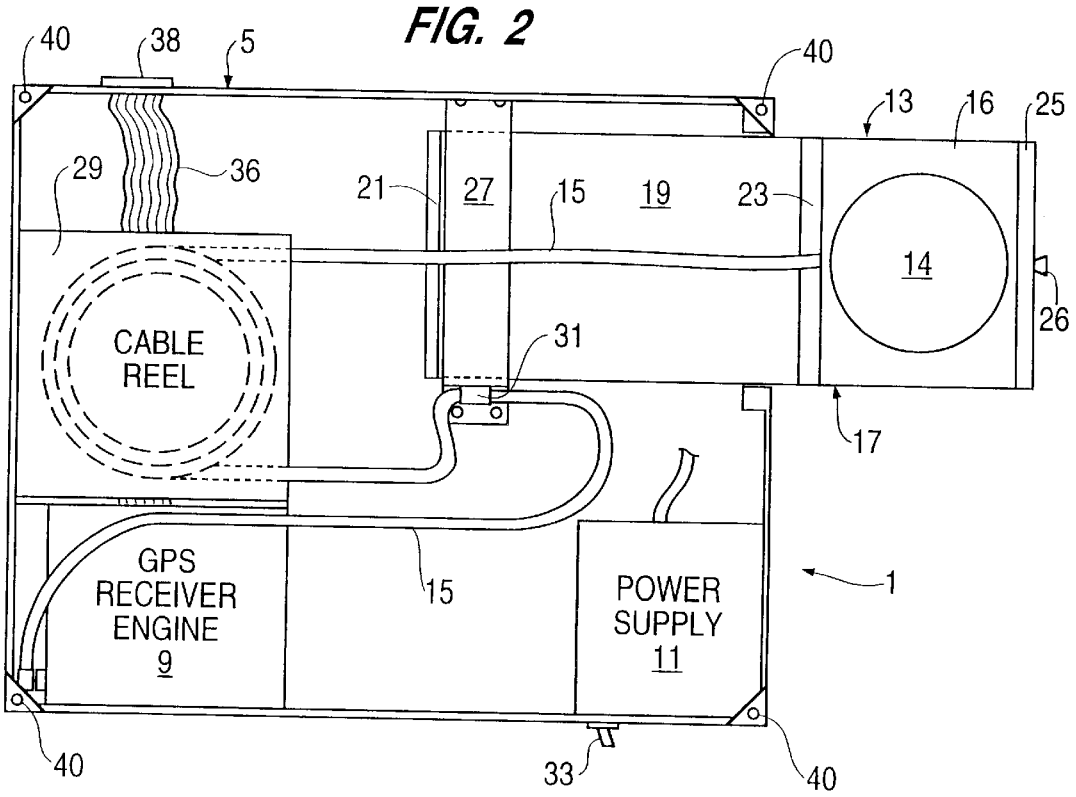
FIG. 2 is a top plan view of the receiver unit shown in FIG. 1, with its lid removed and an antenna carriage thereof shown in its extended position.

The arrangement of components within housing 5 is clearly shown in FIG. 2. The components comprise a GPS receiver engine 9, a power supply 11, and a GPS signal receiving antenna 13.

Receiver engine 9 processes the GPS signals received from antenna 13 and communicates the information to computer 3. Several companies produce GPS receivers on small IC boards suitable for use in the present invention, as mentioned in the Background section. The receiver engine may comprise, e.g., a Rockwell NavCore V GPS receiver board and an RS-232 driver.

GPS receiver engine 9 is connected by a flat cable 36 to a conventional COM port 38 mounted on a sidewall of housing 5. GPS receiver unit 1 will be electrically connected to host computer 3 via a cable extending between COM port 38 and a corresponding COM port on computer 3.

Receiver engine 9 will incorporate firmware that does the actual position calculations based upon the satellite signal data. Additionally, a software driver will be loaded onto computer 3 to allow host computer applications to interact with the attached GPS receiver. The host computer may utilize various application programs for providing the various functions described in the Background section. Obviously, receiver unit 1 can be used in conjunction with other computer peripherals and programs. For example, certain applications such as vehicle navigation will require a CD-ROM drive and CD-ROM cartographic database. A modem and cellular phone can be used to transmit position and time acquisition data from remote locations.

Antenna 13 comprises a coiled wire 14 encapsulated in a solid housing 16. GPS antennas can be purchased that are about 2 inches square and ½ inch thick. For example, suitable antennas are manufactured by the Communications Systems Division of Ball, Inc., of Westminster, Colo., and Ashtech, Inc. of Sunnyvale, Calif. A small size such as this is important so that the antenna can be removably accommodated in housing 5 (which preferably has a thickness of no more than 1.25 inches). A suitable antenna will have a substantial length of cable 15 to enable antenna 13 to be placed remotely from housing 5, as will be described in further detail below.

Figure 4:
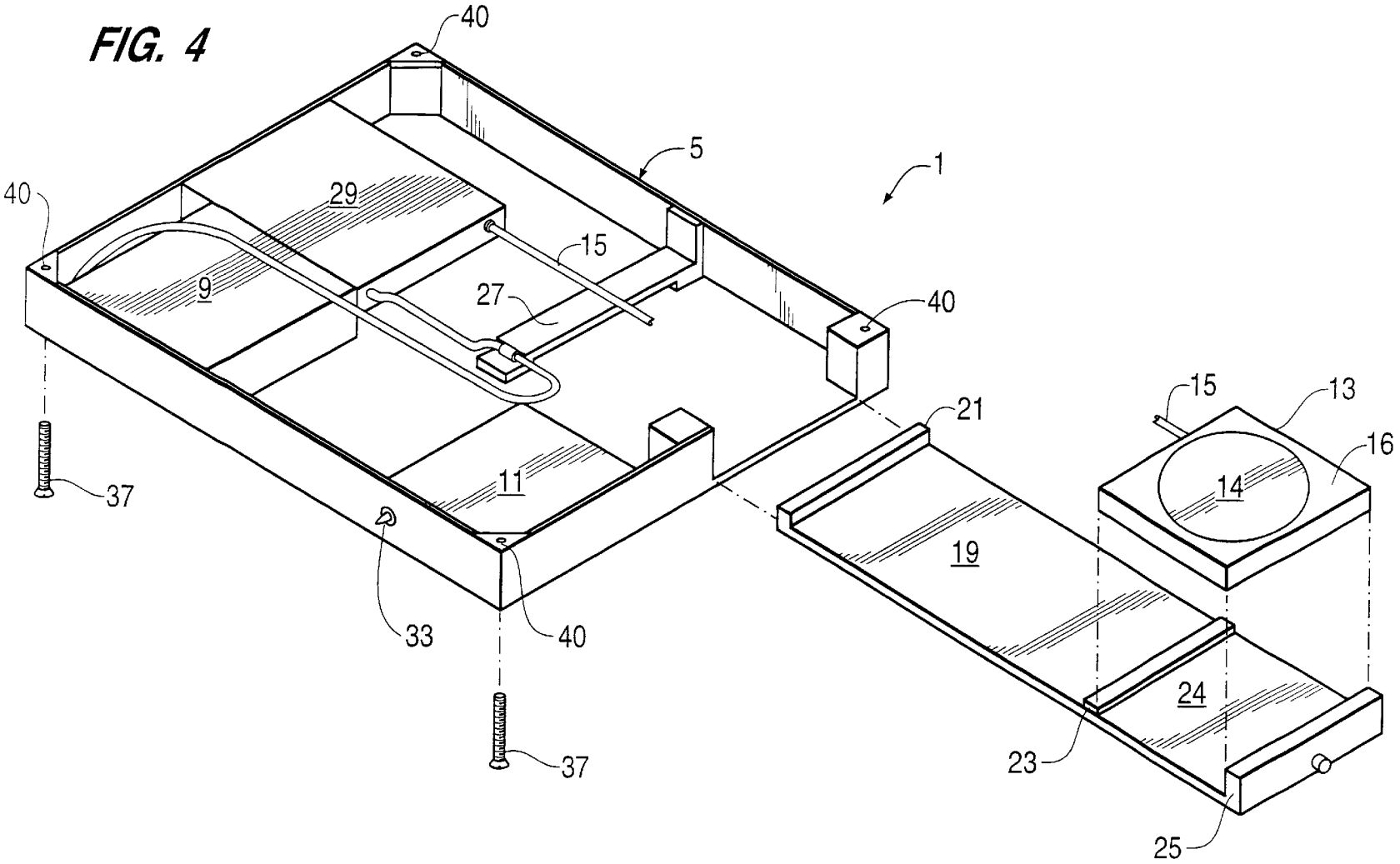
FIG. 4 is a partially exploded perspective view of the inventive GPS receiver unit.

Antenna 13 is mounted for movement into and out of housing 5 on a movable carriage. As illustrated, the carriage is provided as a simple sliding platform 17. Platform 17 is elongated and has three spaced upstanding members 21, 23 and 25. Members 23 and 25 define therebetween a space for removably accommodating antenna 13 on a support surface 24 (FIG. 4) of platform 17. Member 25 also serves as an end panel for covering opening 27 in housing 5 when antenna 13 is retracted into housing 5. Member 25 has a knob 26 or the like for hand grasping platform 17 to move the platform and antenna 13 between the extended and retracted positions.

Antenna 13 is attached to sliding platform 17 by a quick release mechanism, that is, a mechanism that will readily release the antenna without the use of tools. Preferably, this mechanism comprises mutually magnetically attracted elements mounted on the undersurface of antenna 13 and underlying support surface 24 of platform 17. For example, a relatively thin wafer-like permanent magnet 35 (FIG. 1) may be attached to the undersurface of antenna 13, and underlying support surface 24 may be formed with a thin layer of ferrous metal. This arrangement will enable antenna 13 to be removed from platform 17 for remote placement in a position providing a clear view of the sky. The provision of magnet 35 on antenna 13 will allow antenna 13 to be secured to a remote metallic surface such as the roof of an automobile.

Member 21 serves as an abutment to prevent the carriage from being completely removed from the housing when antenna 13 is being moved to the extended position. The platform portion 19 between members 21 and 23 constitutes an extension portion which is slidably received below a bridge structure 27 secured to the floor and sidewall of housing 5. Extension portion 19 and bridge structure 27 cooperate to guide platform 17 in its movement and to support the platform on the housing in a cantilever fashion when platform 17 is in the extended position. While not illustrated, conventional locking means may be provided for releasably locking platform 17 in its retracted and extended positions.

Obviously, carriage structures other than as shown may be utilized to provide retraction and extension of antenna 13. For example, the carriage could utilize a simple track and roller system of the type commonly associated with desk drawers, file cabinets and the like. Alternatively, the carriage could comprise a more sophisticated automatic transport system of the type used in compact disk (CD) players to extend and retract the CD tray.

Figure 3:
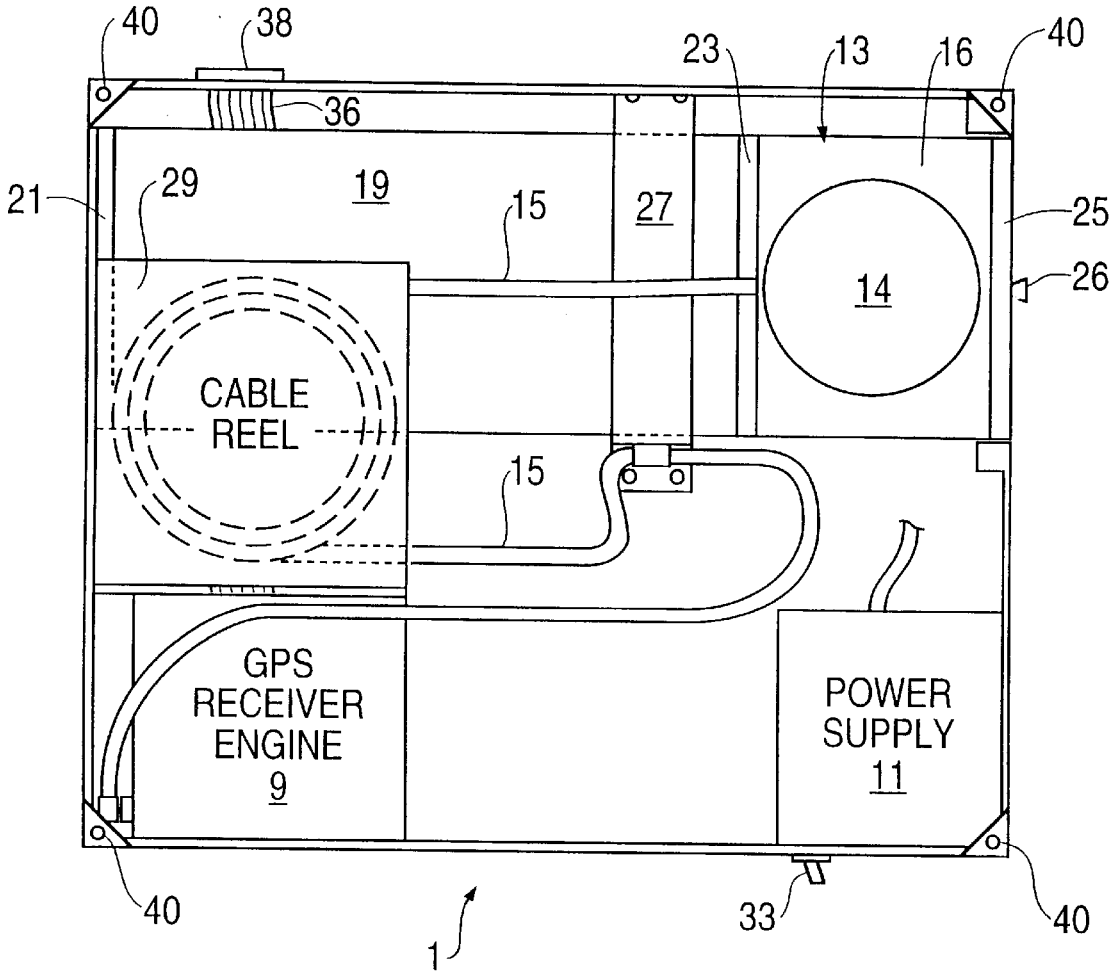
FIG. 3 is a top plan view like FIG. 2, but showing the antenna carriage retracted into the housing.

Antenna cable 15 extends from antenna 13 through a slot provided in upstanding member 23, over bridge 27 and to a cable reel 29 for storing reserve cable length and feeding out cable as necessary. Cable reel 29 may utilize known constructions, and preferably comprises a spring-biased take-up and a releasable locking mechanism. Reel 29 is raised above the floor of housing 5 to allow platform 17 to pass thereunder, as shown in FIG. 3. A clamp 31 on bridge 27 provides strain relief to cable 15.

Power supply 11 may comprise a battery pack such as six 1.5 volt AA batteries, or as an alternative, one 9 volt radio battery or two connected in parallel. Power supply 11 should further comprise a voltage regulator to ensure constant voltage (e.g. 5V) consistent with the requirements of the GPS receiver.

Power supply 11 may comprise an adaptor cord (not shown) for powering receiver unit 1 from an external voltage source such as an automobile battery, e.g., through a cigarette lighter. Power supply 11 may further comprise an AC to DC converter for powering the receiver from a conventional wall socket. Power supply 11 has a toggle switch 33 or the like for switching receiver unit 1 on and off.

A separate power supply is provided in view of the difficulty with tapping into the portable computer's own battery pack, and the drain placed on the battery pack by the computer itself. Power supply 11 will also allow the receiver to continue to track GPS satellites while host computer 3 is turned off, or if the host computer's batteries have been depleted.

Housing 5 is attached to the underside of computer 3 by bolts, screws, or like threaded fasteners 37 (FIG. 4) positioned to pass through corner mounting holes 40 of housing 5 and into corresponding threaded holes in the underside of computer base 7. Preferably, mounting holes 40 are positioned so that fasteners 37 can be secured in standard threaded holes of computer base 7. Obviously, other attachment means may be utilized such as latches and velcro fasteners. Although not shown, housing 5 should be provided with a lid for protecting the internal components when receiver unit 1 is disconnected from computer 3.

The invention has been described in terms of preferred embodiments thereof. Numerous other embodiments and modifications within the scope and spirit of the invention as defined in the appended claims will occur to those having ordinary skill in the art upon reading this disclosure.

I claim:

1. A portable GPS receiver unit comprising:

a GPS receiver engine;

a housing enclosing said receiver engine; and a GPS antenna electrically connected to said receiver engine and being mountable on said housing for movement separate from said receiver engine between a retracted position within said housing and an extended position protruding from said housing.

2. A portable GPS receiver unit according to claim 1, further comprising attachment means for attaching the housing to a separate portable computer, whereby said GPS receiver unit is adapted for use in connection with the separate portable computer.

3. A portable GPS receiver unit according to claim 2, wherein said attachment means mates an upper side of said housing with a bottom side of said portable computer.

4. A portable GPS receiver unit according to claim 3, wherein said attachment means comprises a plurality of threaded fasteners.

5. A portable GPS receiver unit according to claim 3, wherein said housing forms a shallow box having a length and width which are greater than the box depth.

6. A portable GPS receiver unit according to claim 2, further comprising a power supply enclosed within said housing.

7. A portable GPS receiver unit according to claim 6, wherein said power supply comprises a battery pack and voltage regulator.

8. A portable GPS receiver unit according to claim 1, further comprising a movable carriage attached to said housing and having a support surface on which said antenna is mountable for movement with the carriage between said retracted and extended positions.

9. A portable GPS receiver unit according to claim 8, wherein a quick release mechanism removably attaches said antenna to said support surface and allows said antenna to be removed from said carriage manually without the use of tools.

10. A portable GPS receiver unit according to claim 9, further comprising an extension cable allowing remote placement of said antenna away from said receiver unit.

11. A portable GPS receiver unit according to claim 9, wherein said quick release mechanism comprises mutually magnetically attracted elements mounted to said antenna and said support surface, respectively.

12. A portable GPS receiver unit according to claim 11, wherein said antenna has a permanent magnet attached thereto.

13. A portable GPS receiver unit according to claim 12, further comprising an extension cable allowing remote placement of said antenna from said receiver unit.

14. A portable GPS receiver unit according to claim 8, wherein said carriage is slidable along a guideway provided in said housing.

15. A portable GPS receiver unit according to claim 14, wherein said carriage is slidable into and out of an opening in a housing sidewall, in a plane orthogonal to said sidewall.

16. A portable GPS receiver unit according to claim 15, wherein said carriage has an upstanding end panel serving to cover said opening when said antenna is in said retracted position, and stop means for preventing said carriage from being completely removed from said housing when the antenna is moved to the extended position.

17. A portable GPS receiver unit according to claim 15, wherein said carriage comprises an extension portion extending inwardly of the housing from said antenna support surface, said portion serving to guide said carriage in its movement and to support said carriage on said housing in a cantilever fashion when said antenna and carriage are in said extended position.

18. A portable GPS receiver unit according to claim 17, wherein said extension portion is slidably received below a retaining bridge structure provided in said housing.

* * * * *